US007389573B2

(12) United States Patent
Pesta

(10) Patent No.: US 7,389,573 B2
(45) Date of Patent: Jun. 24, 2008

(54) METHOD OF RETROFIT INSTALLATION OF A PORTABLE SWIMMING POOL BARRIER FENCE

(76) Inventor: LeeAnn Pesta, 390 Motor Pkwy., Hauppauge, NY (US) 11788

( * ) Notice: Subject to any disclaimer, the term of this patent is extended or adjusted under 35 U.S.C. 154(b) by 309 days.

(21) Appl. No.: 11/158,859

(22) Filed: Jun. 22, 2005

(65) Prior Publication Data

US 2006/0289845 A1 Dec. 28, 2006

(51) Int. Cl.
*B23P 6/00* (2006.01)
*E04H 17/16* (2006.01)
*E04H 4/00* (2006.01)

(52) U.S. Cl. ..... 29/402.04; 29/401.1; 29/402.03; 29/402.14; 29/402.15; 29/428; 256/24; 4/504

(58) Field of Classification Search ..... 29/401.1, 29/402.04, 402.03, 402.09, 402.14, 402.15, 29/402.17, 426.1, 428, 434; 256/24, 25, 256/59, 73; 4/504
See application file for complete search history.

(56) References Cited

U.S. PATENT DOCUMENTS

| | | | | |
|---|---|---|---|---|
| 3,227,422 | A * | 1/1966 | Loeb | 256/1 |
| 3,234,897 | A | 2/1966 | Berk | 108/152 |
| 3,469,822 | A * | 9/1969 | O'Brien | 256/25 |
| 3,648,301 | A * | 3/1972 | Wiley | 52/169.7 |
| 4,122,631 | A | 10/1978 | Batcheller | 49/394 |
| 4,132,390 | A | 1/1979 | Pfarr, Jr. | 256/24 |
| 4,356,999 | A | 11/1982 | McShane | 256/26 |
| 4,380,327 | A * | 4/1983 | Fish | 256/24 |
| 4,982,457 | A | 1/1991 | Donaton | 4/504 |
| 5,102,103 | A * | 4/1992 | Putnam | 256/12 |
| 5,168,584 | A | 12/1992 | Peebles | 4/504 |
| 5,180,143 | A | 1/1993 | Brower | 256/24 |
| 5,402,988 | A | 4/1995 | Eisele | 256/24 |
| 5,553,833 | A | 9/1996 | Bohen | 256/65 |
| 5,608,926 | A | 3/1997 | Donaton | 4/503 |
| 5,664,769 | A | 9/1997 | Sadinsky et al. | 256/73 |
| 5,718,414 | A | 2/1998 | Deloach et al. | 256/24 |
| 5,800,089 | A | 9/1998 | Donaton | 403/393 |
| 6,076,448 | A | 6/2000 | Rexroad | 87/12 |
| 6,149,135 | A | 11/2000 | Hlavin | 256/24 |
| 6,151,852 | A | 11/2000 | Linn et al. | 52/239 |
| 6,152,428 | A * | 11/2000 | Simioni | 256/24 |
| 6,206,347 | B1 | 3/2001 | Kelley | 256/47 |
| 6,581,914 | B2 | 6/2003 | Saura Sotillos et al. | 256/73 |
| 6,789,786 | B1 | 9/2004 | Schatzberg | 256/25 |
| 6,810,631 | B2 | 11/2004 | Kraft | 52/298 |
| 6,832,752 | B2 | 12/2004 | Cuzzocrea | 256/25 |
| 6,851,661 | B1 | 2/2005 | Penning | 256/59 |
| 6,893,007 | B2 * | 5/2005 | Asenbauer | 256/47 |

(Continued)

*Primary Examiner*—Essama Omgba
(74) *Attorney, Agent, or Firm*—Alfred M. Walker

(57) ABSTRACT

The installation and removal of a portable but sturdy pool barrier fence uses the hardware installed for attaching a safety pool cover during the pool use season. Multiple rectangular panel frames support a mesh fabric. Each panel has a lower horizontal frame member with a series of slots accommodating the same fastener used to attach the pool cover coupling during the off-season. Sections of fencing panels are attached together using bi-fold hinges, which permit 360 degree rotation of one panel relative to an adjacent one. This allows storage of the barrier fence as a dense rectangular three dimensional unit by folding the panels upon each other accordion-like. Sections of fencing panels are joined together to form respective fence units to form the fence around the pool.

7 Claims, 5 Drawing Sheets

U.S. PATENT DOCUMENTS

2006/0060831 A1* 3/2006 Seas ..... 256/24
2006/0231821 A1* 10/2006 Gavin ..... 256/73
2007/0108428 A1* 5/2007 Sadinsky et al. ..... 256/65.14

* cited by examiner

METHOD OF RETROFIT INSTALLATION OF A PORTABLE SWIMMING POOL BARRIER FENCE

FIELD OF THE INVENTION

The present invention relates to a barrier fence which is designed to prevent babies, toddlers and small children up to about five years old from wandering dangerously close to the pool's edge.

BACKGROUND OF THE INVENTION

Although other pool barrier fences are available, they are typically not sturdy and are often unsightly with angled support poles and sagging barrier mesh fabric. The most troublesome aspect of the prior art fences is the need to bore new holes into the pool deck region for initial installation.

OBJECTS OF THE INVENTION

If a seasonal use analysis of swimming pools were considered, the off-season is typically characterized by the use of a safety pool cover. The in-use season where small children or babies and toddlers frequent the area is characterized (or should be) by the use of a barrier fence. In addition, it is very desirable to be able to conveniently remove the fence, store it, and reinstall it. This may be done several times during the in-use season to accommodate adult or teen-age pool parties in addition to the seasonal change dates. The convenience factor can become a crucial safety factor if one were to procrastinate re-installation merely due to the effort involved.

Other objects may become apparent from the following description of the present invention.

SUMMARY OF THE INVENTION

In keeping with these objects and others which may become apparent, the installation and removal of a portable but sturdy pool barrier fence of the present invention takes advantage of the seasonal use analysis by using the hardware installed for attaching a safety pool cover for also attaching a portable barrier fence.

The portable pool barrier fence itself is a collection of fence units configured of multiple fence sections, such as four rectangular panels, each fence section being with a sturdy rigid aluminum or plastic frame supporting a stretched poly-coated open weave mesh fabric. In particular, each pool barrier fence panel section has a lower horizontal frame member with a series of slots designed to accommodate the same anchor screw which is used to attach the pool cover spring coupling during the off-season. In this manner, each fence panel section is attached to the pool deck surface using the same hardware, namely the pre-installed deck anchor and the screw, as used for the pool cover.

Sections of fencing panels are attached together using bi-fold hinges, which permit 360 degree rotation of one panel section relative to an adjacent one. This allows storage of the barrier fence as a dense rectangular three dimensional unit (like a cube) by folding the panel sections upon each other accordion-like. This folding flexibility also makes it easy to follow straight, oval or round contours, to make right angle corners, and to easily avoid obstacles such as roof supports or diving boards.

Typically, each panel section is 3 feet long and 4½ feet in height. Four sections joined together form a fence unit of 12 feet in length. A number of fence units are connected to form an entire fence around a swimming pool.

Additionally, not every panel section need be attached to the deck surface to maintain structural integrity. The many slotted holes on the bottom frame sections offer many opportunities to find one to accommodate the attachment screw over a pool cover anchor, while maintaining almost ideal contour or straight alignment of pool fence panel sections. Obviously, an extra pool cover anchor to accommodate a special fence anchor location can be installed if needed. Any frame section retrofitted with a latch and hinges serves as a gate. In addition, a gate includes a single frame section with a magnetic latch and self closing hinges.

The method of retrofitting the portable pool barrier fence unit to existing swimming pool deck hardware includes the following steps.

First, the swimming pool cover is removed from the swimming pool. Then the pool cover is released from being secured in place by a plurality of spaced anchors on a pool deck which surrounding the pool. Preferably, each anchor includes a solid brass cylinder fully embedded in the swimming pool deck, wherein a fastener, such as a brass screw, is threaded into the anchor, flush with the top surface of the anchor and deck.

Then the fastener screws are removed from a number of the pool cover anchors. Also, preferably, a knurled shoulder is formed on an upper end of each anchor embedded within the swimming pool deck to prevent rotation of the anchor.

Thereafter, frame panel sections of the pool barrier fence are placed upright on the deck, whereon each section is a rectangular frame with bottom, top and side frame members enclosing fencing material, such as a flexible mesh.

The fence sections are then arranged as a preassembled 4-section unit, so that the bottom frame member of each preassembled fence unit of four fence sections spans at least two of the pool anchors.

Then the fasteners, the brass screws, are reinserted thru the brass washers, then through the slots in the bottom frame member of the respective fence section being installed, then into the brass anchor casing, finally, securing the fence section in place on the swimming pool deck. The washers truncated sides to fit on the bottom frame members of the respective fence sections.

Additional fence units are attached by connecting ends of sections via the hinges to the side prior anchored sections and secured in place, as previously described. These additional fence units are each made up of preferably four sections, and they are added to fence units which are already mounted on the deck, until the swimming pool, is fully enclosed by the assembled pool barrier fence formed by the joined units, each preferably formed of four fence sections.

Moreover, to accommodate different angles of orientation of the fence sections, the fence sections are swivelly attached to each other using bi-fold hinges.

Finally, at the end of the swimming season, the joined units of fence sections are removed from the pool deck, and the sections are foldable as a unit at the bi-fold hinges for convenient storage, then the pool cover is reinstalled over the swimming pool for the ensuing non-swimming winter season.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

The present invention has broad applications to many technical fields for a variety of articles. For illustrative purposes only, a preferred mode for carrying out the invention is described herein, wherein the installation and removal of a portable but sturdy pool barrier fence of the present invention takes advantage of the seasonal use analysis by using the hardware installed for attaching a safety pool cover for also attaching a portable barrier fence.

Figure 1:
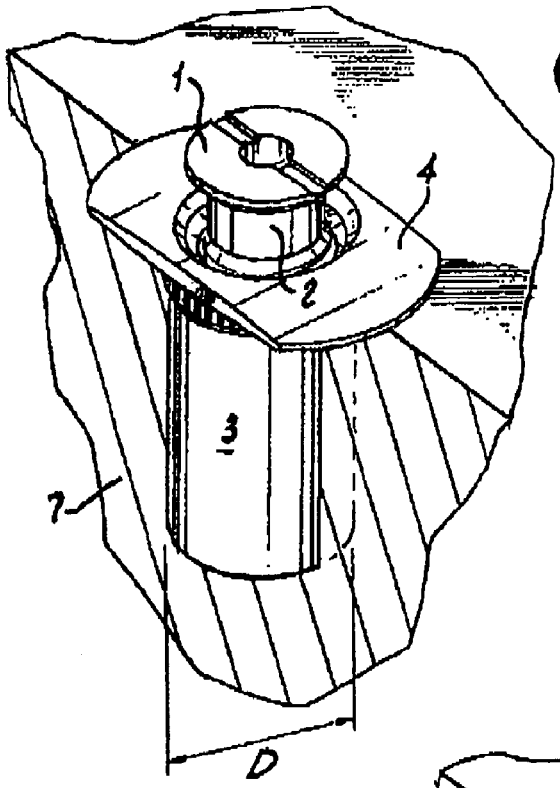
FIG. 1 (Prior Art)
FIG. 1 is a side view of a prior art installed pool anchor with washer and screw in its pool cover configuration; this prior art figure shows the deck in cross section.

FIG. 1 shows a side view of the preferred type of prior-art pool cover anchor 3 as installed in pool deck 7. Anchor 3 is a heavy-walled brass cylinder with diameter D of 0.75" (19 mm) with closed bottom and top ring with a straight knurl as an anti-rotation feature; it has a central threaded hole (not shown) to accept pool cover screw 1. Screw 1 is a large brass screw with a flat head and smooth shank 2 which accepts the attachment ring of a pool cover. A contoured heavy brass washer 4 with a countersink hole is also shown. During seasonal use, the pool cover is removed.

Figure 2:
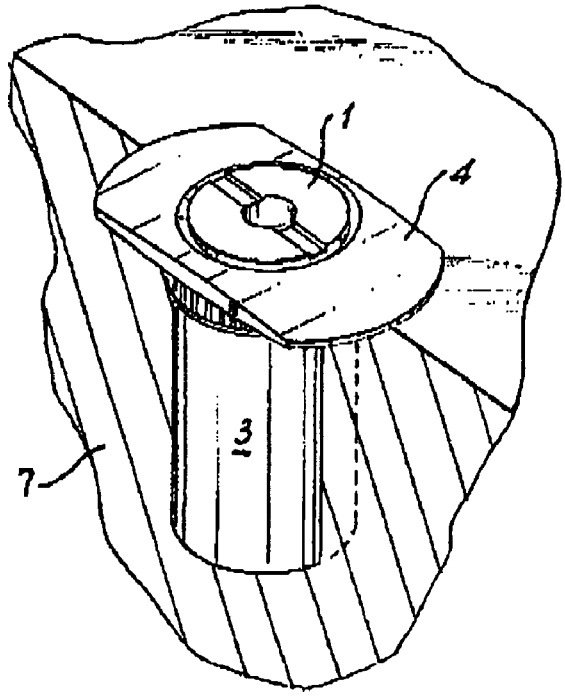
FIG. 2 (Prior Art)
FIG. 2 is a side view of the installed prior art pool anchor of FIG. 1 with the screw screwed down into the anchor.

FIG. 2 shows that to avoid debris from entering the hole in anchor 3 and to provide a convenient storage for screw 1, it is just screwed down into anchor 3 to seat into the countersink hole in contoured washer 4. Washer 4 provides a non-obtrusive surface not injurious to bare feet.

Figure 3:
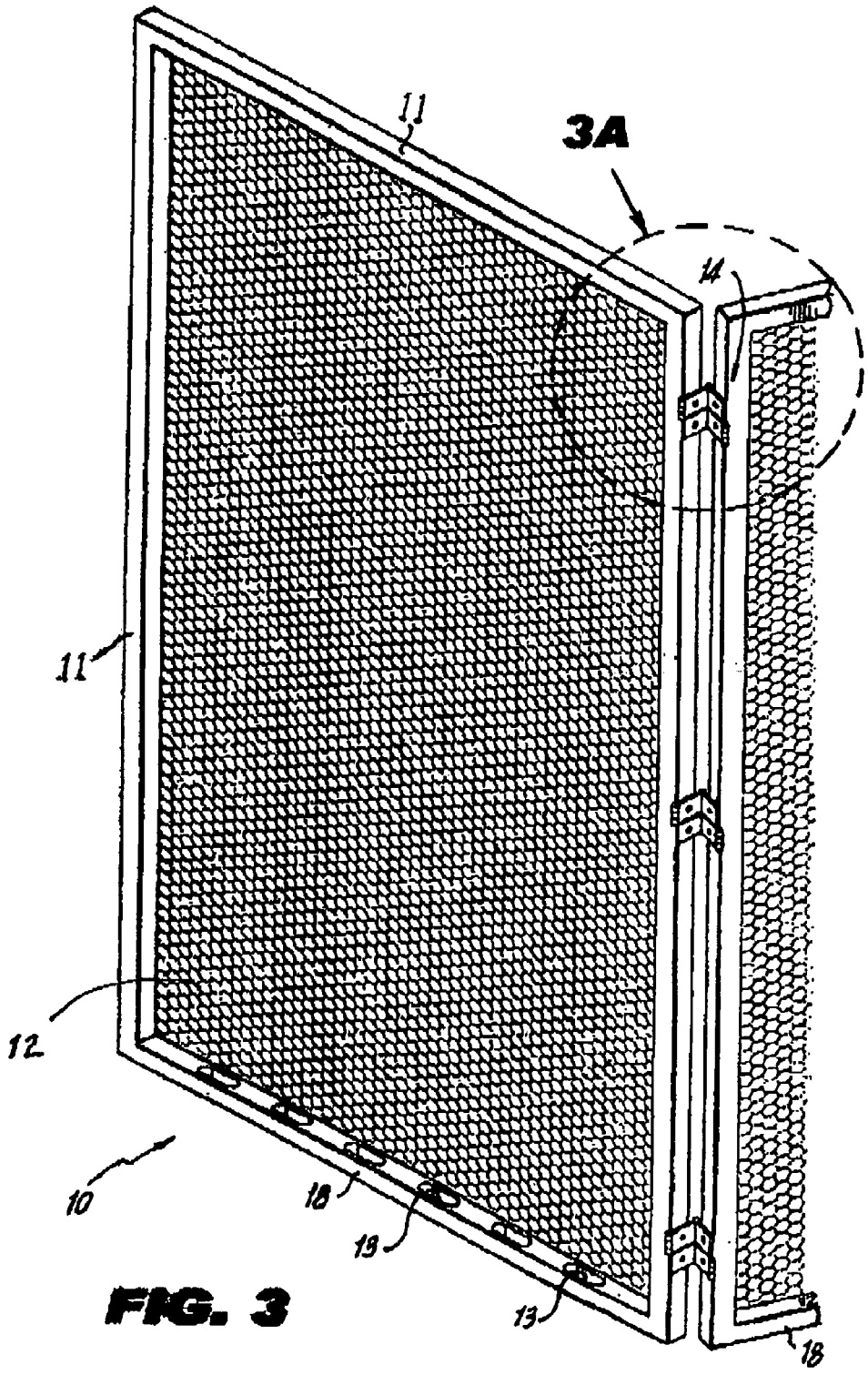
FIG. 3 is a perspective view of a portable pool barrier fence frame section of a unit of fence sections forming the pool barrier fence of this invention.
Figure 3A:
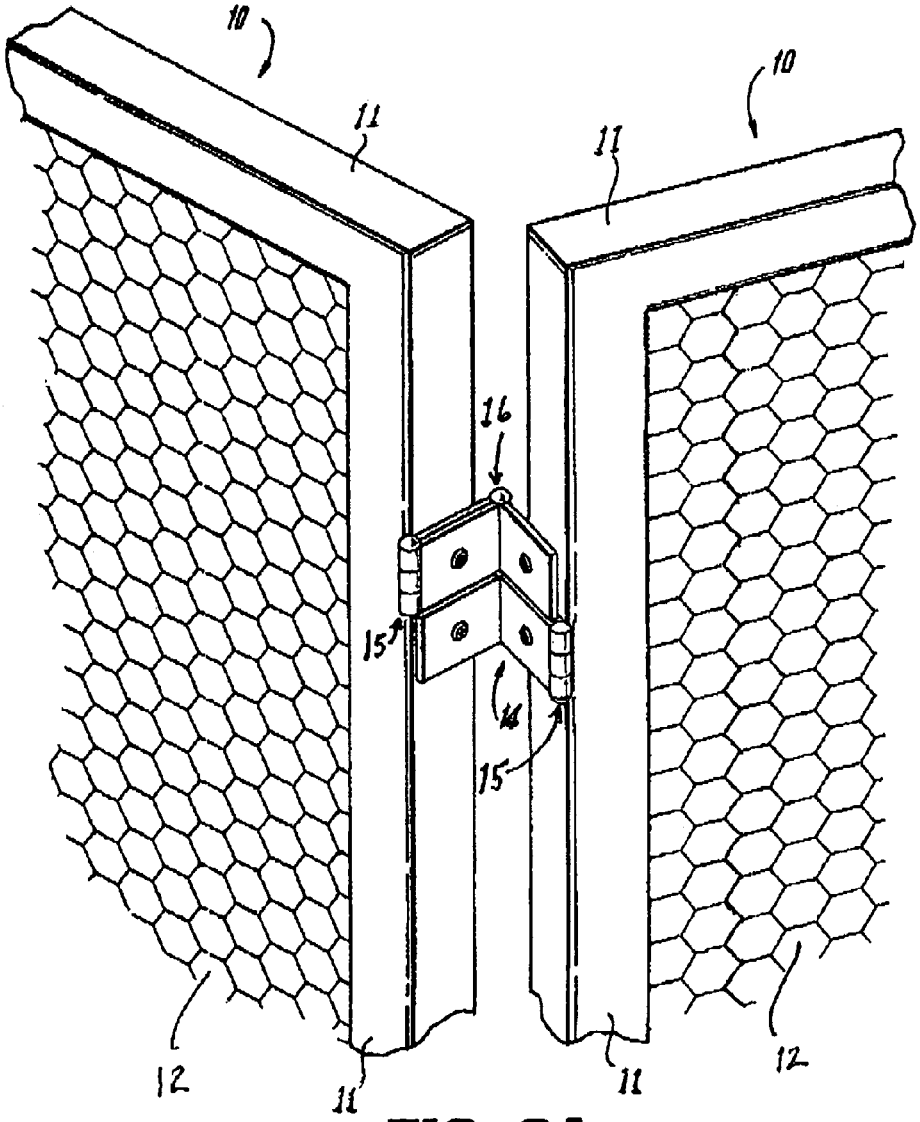
FIG. 3A is a close-up perspective view of a portable pool barrier fence frame section of this invention.

FIGS. 3 and 3A show a single fence section 10 of the pool barrier fence of the present invention with rigid frame 11 and stretched poly-coated open weave panel 12. Bottom frame section 18 with an array of slotted holes 13 is used to attach the fence section 10 to deck 7. One attached three segment bi-fold hinge 14 is shown on the right vertical frame 11 member. Hinge 14 has fastener access hole 16 in the center segment, and fastener attachment hole 15 which would be used to attach to an adjacent unit section 10. Unless an end section 10, the left vertical frame 11 member will also have two bi-fold hinges 14 attached.

Figure 4:
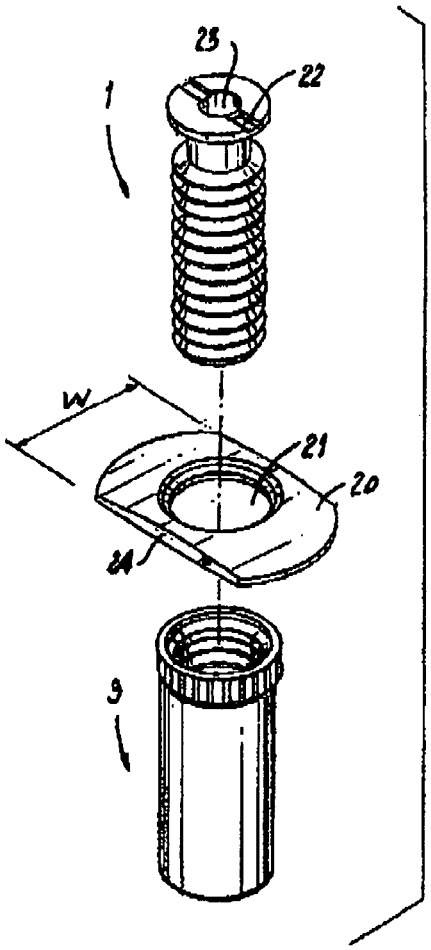
FIG. 4 is an exploded perspective view of a prior art pool anchor screw and a contoured washer of this invention.

FIG. 4 shows anchor screw 1 with a flat head having both a driving slot 22 as well as hex wrench recess 23. Oval type contoured washer 20 has truncated sides to width W, the depth of bottom frame member 18 of fence section 10. Washer 20 is preferably heavy brass with a countersunk central hole and smooth contours.

Figure 5:
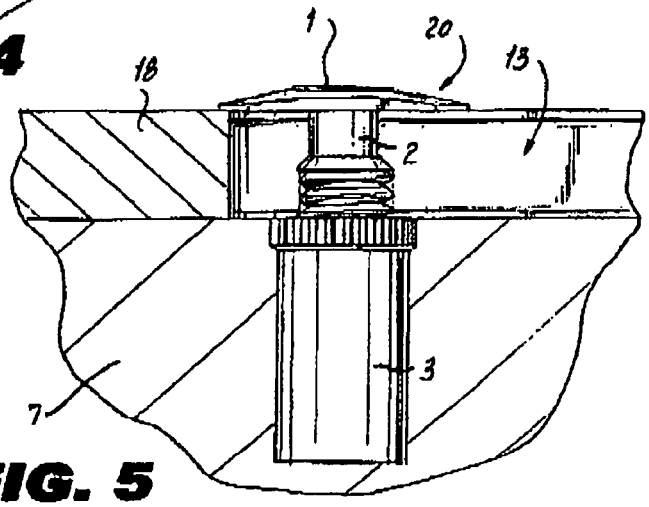
FIG. 5 is a side view detail of the bottom frame member of a fence panel section of the pool barrier fence of this invention in the vicinity of a slotted hole, along the long axis centerline, showing the installation of the anchor screw in the pre-installed anchor.

FIG. 5 is a side cross section illustration of the attachment of frame member 18 of fence section 10 to deck 7 via pre-existing anchor 3, screw 1 and washer 20. Screw 1 can penetrate slotted hole 13 anywhere along its length and exert holding force on member 18 via washer 20 bridging the entire depth of member 18 including the inner and outer edges of slotted hole 13. This makes it easier to line up an anchor 3 with the fence section 10 in the desired orientation.

Figure 6:
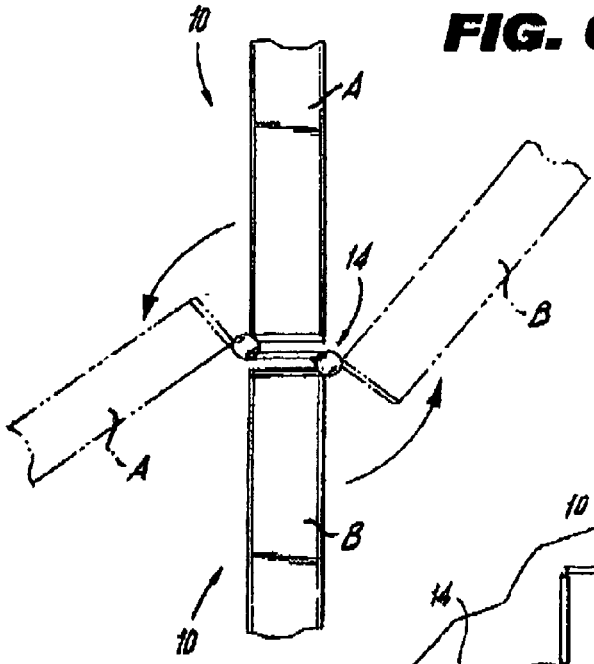
FIG. 6 is a top plan view of two fence panel sections attached via a three segment bi-fold hinge, illustrating the range of motion permitted by the arrangement of the portable pool barrier fence of this invention; and, FIG. 7 is a top view of a typical pool encircled by the portable barrier fence of this invention.

FIG. 6 shows the attachment of bi-fold hinge 14 to two adjacent fence sections 10. It is noted that the two fence sections 10 can swing while still being attached. In particular, if fence section A is held in its original position, fence section B can be swung adjacent to it. This means that a whole string of attached sections can be folded like an accordion to create a compact storage configuration.

Figure 7:
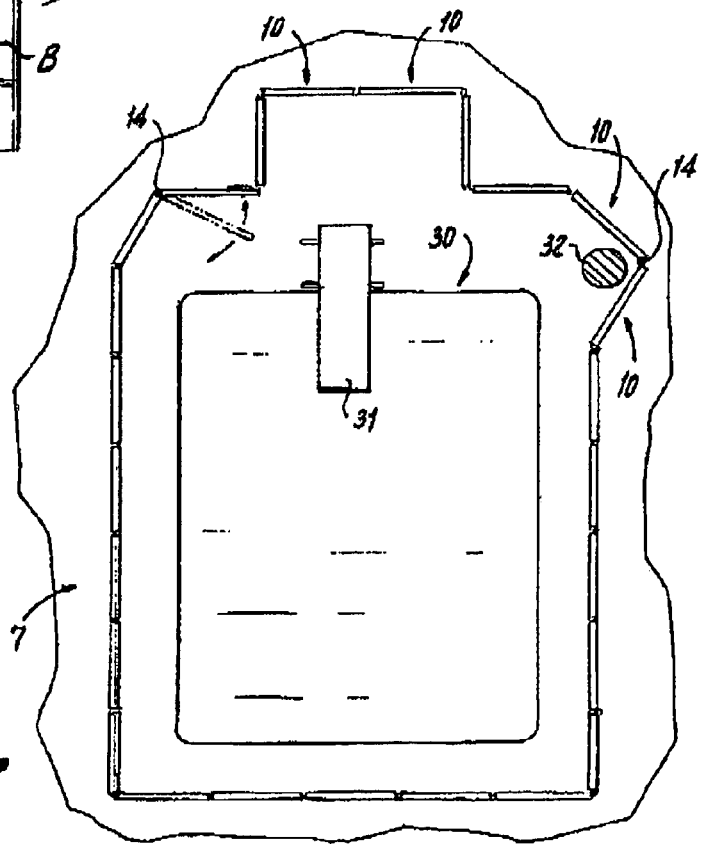

FIG. 7 shows pool 30 encircled by many attached sections 10 of the portable barrier fence of this invention. It is with considerable ease that the corners are made and obstacles such as column 32 or diving board 31 are avoided.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A method of retrofitting a swimming pool with a barrier fence comprising the steps of:

removing a swimming pool cover from said swimming pool, said pool cover being secured in place by a plurality of spaced anchors on a pool deck surrounding said pool, each anchor comprising a solid cylinder fully embedded in said deck, a screw threaded into said anchor, and a washer on said screw flush with a top surface of said anchor and deck, each anchor securing a portion of said swimming pool cover;

removing screws from a number of said anchors;

placing upright on said deck a fence unit of a collection of fence sections of said barrier fence, each respective fence section comprising a rectangular frame with bottom, top and side frame members, said frame members enclosing fencing material;

whereby four (4) fence sections are joined to form one fence unit in them:

arranging a respective fence unit so that said each respective bottom frame member of a collection of bottom frame members spans at least two of said anchors;

aligning said bottom frame members of said respective fence unit with said anchors;

attaching said respective bottom frame members to said anchors with respective screws;

reinserting said screws and washers into said anchors, to secure said fence unit in place on said deck;

attaching additional fence units to the side frame members and securing the additional fence units by attaching said additional bottom frame members of said additional fence units to further anchors with further respective screws, reinserting said screws into the aligned anchors; and, adding additional fence units of said fence to fence units already mounted on said deck, until the swimming pool is fully enclosed.

2. The method of claim 1 in which said fence units are swivelly attached to each other using bi-fold hinges.

3. The method of claim 2 in which said fence units are removable from said deck and foldable at said bi-fold hinges for convenient storage when said pool cover is reinstalled.

4. The method of claim 1 wherein the bottom frame members of said fence units include elongated slots to simplify the alignment of said anchors of said pool deck with said slots.

5. The method of claim 4 in which said washers have truncated sides to fit on said bottom frame members.

6. The method of claim 5 in which a knurled shoulder is formed on an upper end of each anchor embedded within said deck, to prevent rotation of said anchor.

7. The method of claim 1 wherein said screws are attached to said respective bottom frame members through respective slots in said respective bottom frame members.

* * * * *